US007156716B1

(12) United States Patent
Belykh

(10) Patent No.: US 7,156,716 B1
(45) Date of Patent: Jan. 2, 2007

(54) APPARATUS, GAME AND METHOD FOR CAPTURING ARTICLES WITH COIL SPRING

(76) Inventor: Igor Belykh, 3943 El Camino Real, #12, Palo Alto, CA (US) 94306

( * ) Notice: Subject to any disclaimer, the term of this patent is extended or adjusted under 35 U.S.C. 154(b) by 143 days.

(21) Appl. No.: 10/829,835

(22) Filed: Apr. 21, 2004

(51) Int. Cl.
*A63H 33/00* (2006.01)

(52) U.S. Cl. ..... 446/486; 446/489

(58) Field of Classification Search ..... 446/486, 446/128, 489; 273/447, 148 R; 294/19.2, 294/19.1
See application file for complete search history.

(56) References Cited

U.S. PATENT DOCUMENTS

| | | | | |
|---|---|---|---|---|
| 2,415,012 | A | 1/1947 | James | 446/486 |
| 2,854,786 | A | 10/1958 | Sabo | 446/486 |
| 3,005,282 | A | 10/1961 | Christiansen | 446/128 |
| 3,712,658 | A * | 1/1973 | Yaresh | 294/19.2 |
| 4,045,068 | A * | 8/1977 | Nelson | 294/19.2 |
| 4,114,306 | A | 9/1978 | Molenaar | 446/486 |
| 4,731,042 | A | 3/1988 | McKay et al. | 446/309 |
| 5,112,093 | A * | 5/1992 | Kindling | 294/19.2 |
| 5,178,576 | A | 1/1993 | Ayers | 446/486 |
| 5,390,653 | A | 2/1995 | Lee et al. | 124/16 |
| 5,407,242 | A | 4/1995 | Beranek | 294/19.2 |
| 5,423,710 | A * | 6/1995 | Tomberlin | 446/486 |
| D371,581 | S * | 7/1996 | Jarnros | D21/494 |
| 5,580,293 | A | 12/1996 | Sestak et al. | 446/75 |
| 5,667,221 | A | 9/1997 | Lievre | 273/153 R |
| 5,692,737 | A * | 12/1997 | Perlsweig | 446/486 |
| 5,727,984 | A * | 3/1998 | Lin | 446/431 |
| 5,997,062 | A * | 12/1999 | Schwartz | 294/19.2 |
| 6,000,991 | A | 12/1999 | Truchsess et al. | 446/397 |
| 6,050,625 | A | 4/2000 | Nisbet | 294/19.2 |
| 6,099,381 | A | 8/2000 | Sodeshima | 446/487 |
| 6,412,839 | B1 | 7/2002 | Tran | 446/486 |
| 6,422,621 | B1 | 7/2002 | Tandlich | 294/19.2 |
| 6,461,220 | B1 * | 10/2002 | Ming | 446/486 |
| 6,482,071 | B1 | 11/2002 | Wilgosz | 294/19.2 |
| 6,554,684 | B1 | 4/2003 | Marlin | 446/486 |
| 6,763,681 | B1 * | 7/2004 | Klundt | 63/1.11 |
| 2002/0094753 | A1 | 7/2002 | Campos et al. | |
| 2002/0102912 | A1 | 8/2002 | Duval | 446/486 |

FOREIGN PATENT DOCUMENTS

| | | |
|---|---|---|
| GB | 2167969 | 6/1986 |
| RU | SU 1379107 A1 * | 6/1990 |

* cited by examiner

*Primary Examiner*—Kien Nguyen
(74) *Attorney, Agent, or Firm*—JDI Patent; Joshua D. Isenberg

(57) ABSTRACT

A coil spring toy with the ball-trapping tool attached to one or more ends is disclosed. The coil spring toy may be used with a game apparatus having a toy stairway, and a set of lightweight balls of a specific size. A method to play the game includes mechanically starting the spring toy to move downstairs due to gravity and its known properties. If started properly, a spring toy will capture the balls, located on the stairs, with the trapping tool, while it lands on each stair. Captured balls may be kept inside spring toy while it moves and finally stops. The balls may be transparent and may be filled with particles to produce additional visual and sound effects. Collected balls can be manually released out of spring toy by means of its stretching. After balls are released and counted, and are placed back on the stairs, the action may be repeated. The goal of the game is to start a spring toy so that it will collect the maximal number of balls on the stairs during one or several actions in order to get the maximal number of points of designated values.

25 Claims, 10 Drawing Sheets

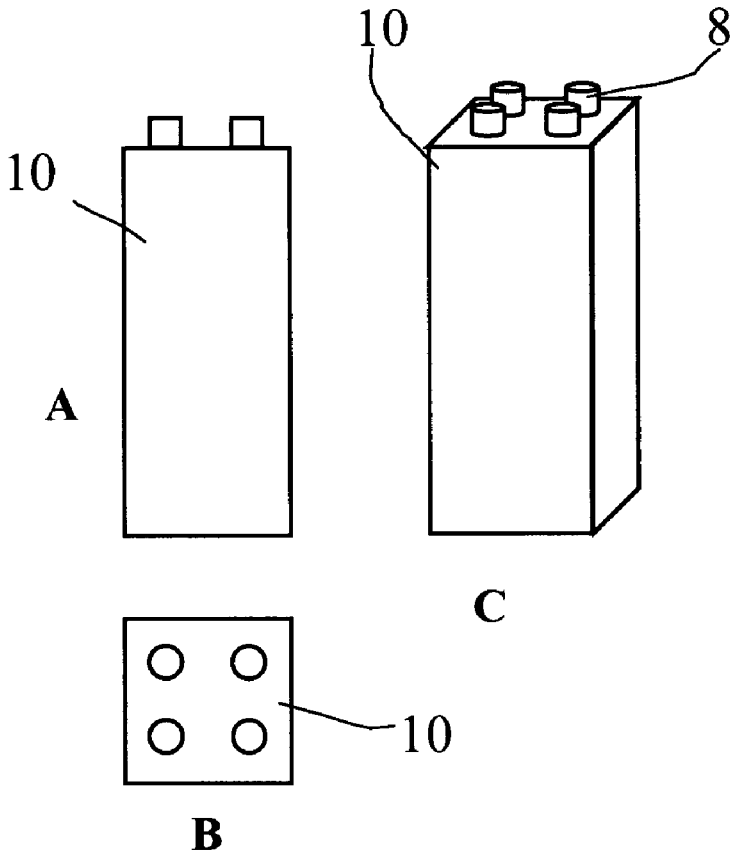
FIG. 2
FIG. 3
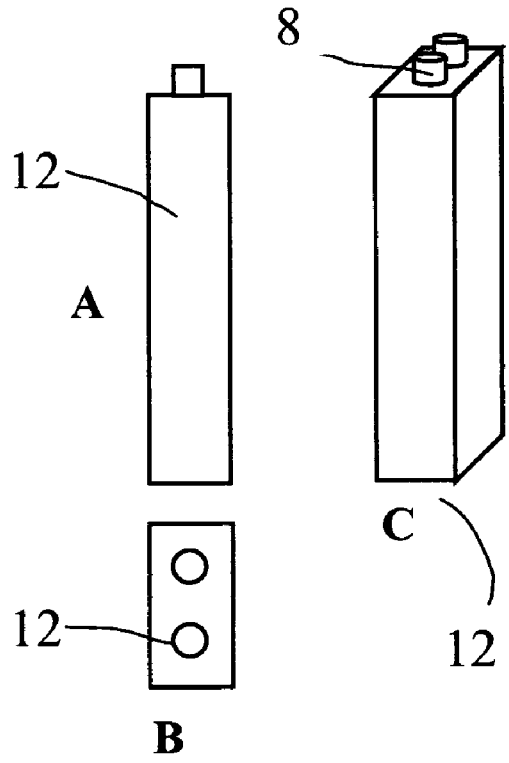

APPARATUS, GAME AND METHOD FOR CAPTURING ARTICLES WITH COIL SPRING

FIELD OF THE INVENTION

The present invention relates to the game and, more particularly, to constructed plastic toy with some parts mechanically and gravity driven.

BACKGROUND OF THE INVENTION

A popular spring toy, sold under the well-known brand name SLINKY®, was disclosed in U.S. Pat. No. 2,415,012 issued on Jan. 28, 1947 and later was described in U.S. Pat. No. 4,114,306 issued on Sep. 19, 1978. The play value of this toy is based on its many unique features, i.e. when holding one end of the toy in one hand and the other end in another hand the coils will unravel in the direction of the lower hand when one hand is raised or lowered. It behaves like a living creature, moving in one's hand. Additionally, the spring toy creates an interesting visual effect and generates attractive sound while it moves, further entertaining the user. It is also known on the market as a stress relief spring toy.

The spring toy was further developed by means of adding sound and lighting devices disclosed in U.S. Pat. No. 6,000,991 and U.S. Pat. No. 6,482,071 or coating described in UK patent GB2167969A. An amusement coil spring with attached ball for producing an intriguing sound effect was disclosed in U.S. Pat. No. 3,703,292. An adhesive toy jumping along a vertical surface was described in U.S. Pat. No. 6,461,220. This toy was based on coil spring with adhesive bodies connected to its both ends. A stress reliever using multiple concentrically positioned coil springs was disclosed in U.S. Pat. No. 5,692,737.

Part of the spring toy's remarkable play value lies in its unique ability to move down a stairway of a specific size or incline due to gravity and inertia, converting its potential energy into kinetic energy. When a user mechanically starts the motion of the toy by advancing one of the top coils of the toy to the next lower level, the momentum of these top coils carries through to the remaining coils, causing them to follow the top coils in turn to the next lower level, and in the process appearing to "walk" down to the next lower level. At this lower level, the momentum of the coils, which are now on top, causes them to flip over and fall to the next further lower level, thus repeating the motion. This "walking" movement continues until the toy reaches the bottom of the stairway or incline, where it stops.

A method for manipulating a spring toy was disclosed in U.S. Pat. No. 5,178,576 issued on Jan. 12, 1993 using a pair of 2-level platform devices kept in two hands to maintain the periodic step-walking motion of the spring toy from one hand to another.

A toy stairway was disclosed and possible stairway designs were discussed in U.S. Pat. No. 5,580,293 issued to Sestak et al. on Dec. 3, 1996. In that patent authors emphasized a need for design a toy stairway of specific size to make the game with "walking downstairs" spring toy more convenient and safe for children. Using stairway proposed in that invention, children can play inside any household instead of constructing a simulated stairway with a stack of books or similar objects or searching for a stairway of appropriate size and quality (e.g. uncarpeted) somewhere outside. The stairway also provides for children a safe way to play so that they do not need to climb the stairs each time they start a spring toy. The described stairway comprises 2 coilable and resilient side rails in confronting spaced relationship relative to each other, a plurality of L-shaped rigid steps disposed between the first and second side rails, and means for releasably connecting the plurality of steps to the first and second side rails. Advantage of the disclosed stairway is that it can be packaged in a small carton along with the spring toy for shipping, storage and merchandising benefits and that it can be relatively easy assembled.

There are several disadvantages though of such stairway design and construction: one of them is that it may not be easy to assemble the construction for small children due to specific type of connectors; another one is that its parts are of specific shape, size and design and therefore they cannot be used in other games or to build other constructions; the third one is that it is not possible to construct a few stairs without unfolding side rails to a full size.

There is also a general disadvantage of such kind of game, i.e. it is most likely an amusement game and it is not well determined from competitive point of view. Let's suppose, for instance, that the goal of the game is to reach the maximal number of stairs passed by a spring toy, which was started consequently by different players. It is hard to define the winner if the age and/or skills of players are similar, because there might be some points to argue. For example, if a spring toy, started by one player, went out of stairway at one of the stairs, hitting just its edge, or a spring toy may simply fall on a stair and roll or there might be many other unpredictable spring toy landings. In such cases it is not clear how to define the winner. To solve such problems a referee and/or well-determined rules are needed. This seems to be complicated and inconvenient for small children. So, there is a need for more accurate quantitative evaluation of players' skills.

The amusement effect of using the balls while playing with spring toy, held in the hands, was described in U.S. Pat. No. 2,854,786 issued to Sabo on Oct. 7, 1958. However, this patent did not include a mechanism for capturing and retaining the balls.

There were some prior art games and toys based on capturing of articles. U.S. Pat. No. 4,731,042 issued on Mar. 15, 1988 disclosed a toy for capturing a toy victim with a snare net, which is large enough when opened to fit over and around at least part of the victim. A catching toy was disclosed in U.S. Pat. No. 6,099,381 and includes two semi-sphere containers—the upper one and the lower one of smaller size triggered and movable inside the upper one—to form a sphere chamber large enough to contain an object to be caught. The toy is operated with a string attached to the upper container. A flexible coiled lasso toy, disclosed in U.S. Pat. No. 6,554,684 issued on Apr. 29, 2003, can wrap around different objects. In U.S. patent application 2002/0094753 A1 published on Jul. 18, 2002 there was disclosed a toy, a game and a method to play a game that consists in picking up an article or target by a resilient coil toy. One end of coil toy is held by a player, another end of coil toy and each article are provided with complementary attachment tacky or sticky surfaces for capturing purpose.

All capturing methods and devices described in the paragraph above are manually operated during the whole game action and are designed to trap/pick up only one object at a time. In U.S. Pat. No. 5,390,653 issued on Feb. 21, 1995 a two handed pistol-like toss and catch toy for catching multiple balls was disclosed. In the present invention the spring toy can capture multiple balls and it requires only to be started manually but further capturing process goes without manual control. In U.S. patent application 2002/

0094753 published on Aug. 1, 2002 a toy and a method for washing a body of an individual were disclosed based on resilient coil with one or more bodies in the shape of identifiable objects attached to the coil.

There were several previous efforts in the art related to the proposed ball-trapping tool. However, none of these ball-trapping tools were employed for trapping balls with a spring toy. For example U.S. Pat. No. 6,050,625 issued on Apr. 18, 2000, discloses a table tennis ball retrieving and dispensing system. A tubular retriever can hold a column of balls and is deployed in a hand-held manner in a vertical orientation from a standing position. The retriever is fitted at its bottom end with a ball trap including (a) a flexible coaxial constriction ring defining an expandable entry opening that when lowered over a stray ball captures and retains it in the retriever tube, and (b) a flexible coaxial guidance flange extending outwardly and downwardly to provide initial capturing of a stray ball. Such a retriever captures a ball in 3 main steps: (1) manual positioning of the tube (2) initial capturing by guidance flange and (3) final trapping by coaxial constriction ring. The disadvantage of such ball retriever, if considered for use as a trapping tool in embodiments of the invention, is that its constriction ring needs to be positioned very precisely with respect to center of the ball. So it would significantly reduce the probability of ball capturing by a moving spring toy. That is why the 3 steps above are needed with manual control for successful ball capturing.

U.S. Pat. No. 5,407,242 discloses a cylindrical collection drum having a plurality of circumferential tines axially spaced apart by a dimension just less than the diameter of a tennis ball. At least one of the circumferential tines has an abrasive surface for engaging the tennis ball and urging it between an axially spaced-apart pair of the circumferential tines and into the collection drum. Another modification of tennis ball retriever was disclosed in U.S. Pat. No. 6,412,839 and is based on tennis ball pushing through spaced bars in the base of the receptacle. U.S. Pat. No. 6,422,621 disclosed tennis ball retriever based on modified cylindrical collection drum having circular cylinder bases spaced from one another. The cylindrical collection drum has openings formed in a peripheral cylinder region such that balls can be pushed therethrough. The disadvantage of tennis ball retrievers described above with regard to the present invention is that they are manually operated for each ball capture by means of rolling a drum or moving a basket with a handle along the ground to collect the loose balls.

There were no prior efforts found in the art to mount a ball-trapping tool to a coil spring toy.

Thus, there is a need in the art, for a spring toy with a ball trapping tool and a game based on such a toy.

SUMMARY OF THE INVENTION

Embodiments of the present invention overcome advantages associated with prior art spring toy games. In embodiments of the present invention the games based on moving a spring toy downstairs may be enhanced by placing a set of articles, e.g., lightweight hollow plastic balls, on the stairs and by providing a spring toy with a trapping mechanism. The spring toy can capture the articles with the trapping tool while the spring toy "walks" downstairs. In an embodiment of the invention, the goal of the game may be to start a spring toy so, that it will collect the maximal number of the articles on its way downstairs. The winner can be defined by counting the articles captured during one or several actions. These enhancements to the game allow more accurate evaluation of both the quantity and quality of the game. Moreover, the process of capturing articles by a moving spring toy provides an additional element of entertainment and motivation.

The game apparatus may include three main parts: a toy stairway, a set of articles, such as lightweight balls, of specific size and a coil spring toy with the trapping tool attached to each of its end. The stairway is constructed using widely marketed universal building blocks with some modifications. A trapping mechanism may be incorporated into the spring toy by suitable modification of the spring toy's ends. In one particular embodiment, the trapping mechanism may include a ring attached to an end of the spring toy. Two parallel thin elastic flexible threads divide the area of the ring into three sub-areas that are almost equal in width, measured along the ring diameter in dimension perpendicular to the threads. The diameter of the articles (e.g., balls) may be slightly greater than one third of ring internal diameter. In other embodiments, the lightweight balls may be transparent and filled with lightweight particles of different colors to produce additional visual and sound effects during the game action.

To set the game ready for use, a toy stairway may be assembled from plastic blocks. A desired number of articles (e.g., balls) may then be placed at positions defined by dimples on the stairs, and a spring toy may be placed at its starting position on the top stair.

Game action begins by placing a spring toy on a top stair and mechanically starting the spring toy to move downstairs due to gravity and it's known properties as previously described. A spring toy, if started properly, i.e. the center of its landing ring is positioned with some accuracy relative to the article located on the next stair, will capture the ball or other article with the trapping mechanism. The ball or other article can be pushed inside the spring toy cylindrical space between the two threads (or between the ring edge and a thread) due to spring toy increasing weight while it lands on a stair. The elasticity of the threads prevents the ball or article from getting out of spring toy internal space. The articles located on the next stairs can be trapped the same way. All captured articles can be kept inside spring toy space, while it moves downstairs and finally stops. Collected articles or balls can be manually released from inside the spring by sufficiently stretching the spring toy. The action may be repeated as soon as articles are released and counted, and are placed back on the stairs. Another set of the balls or articles can be used instead of collected one. The goal of the game is to start a spring toy so that it will collect the maximal number of articles during one or several actions in order to get the maximal number of points of designated values.

An important aspect of the present invention is that apparatus and method to play a game provide a unique feature of a modified spring toy to catch, to keep inside and to "carry" collected articles while it moves downstairs.

BRIEF DESCRIPTION OF THE DRAWINGS

The teachings of the present invention can be readily understood by considering the following detailed description in conjunction with the accompanying drawings, in which:

FIG. 2. Illustrates a full width post from a set of building blocks needed to assemble the toy stairway: A—side view, B—top view, C—isometric view.

FIG. 3. Illustrates a half width post from a set of building blocks needed to assemble the toy stairway: A—side view, B—top view, C—isometric view.

DESCRIPTION OF THE SPECIFIC EMBODIMENTS

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Figure 1:
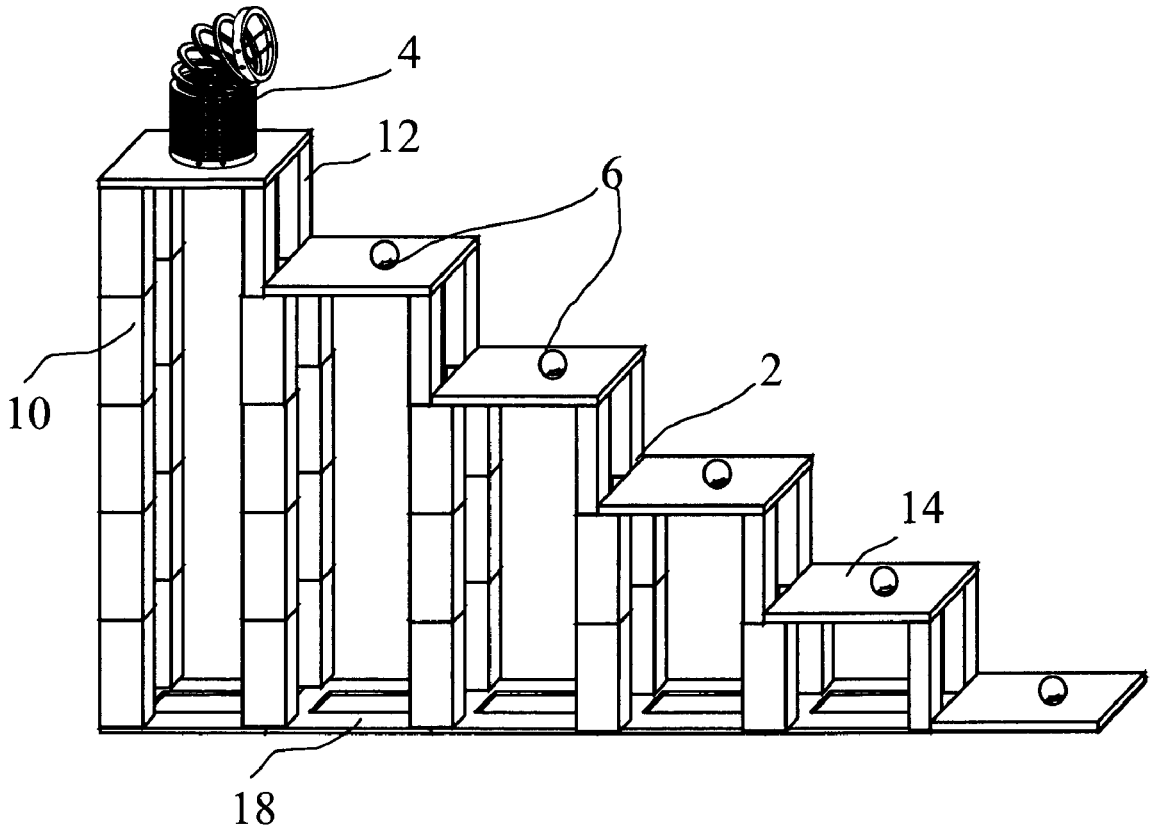
FIG. 1. Illustrates all parts of the game assembled with a spring toy at starting position.
Figure 11:
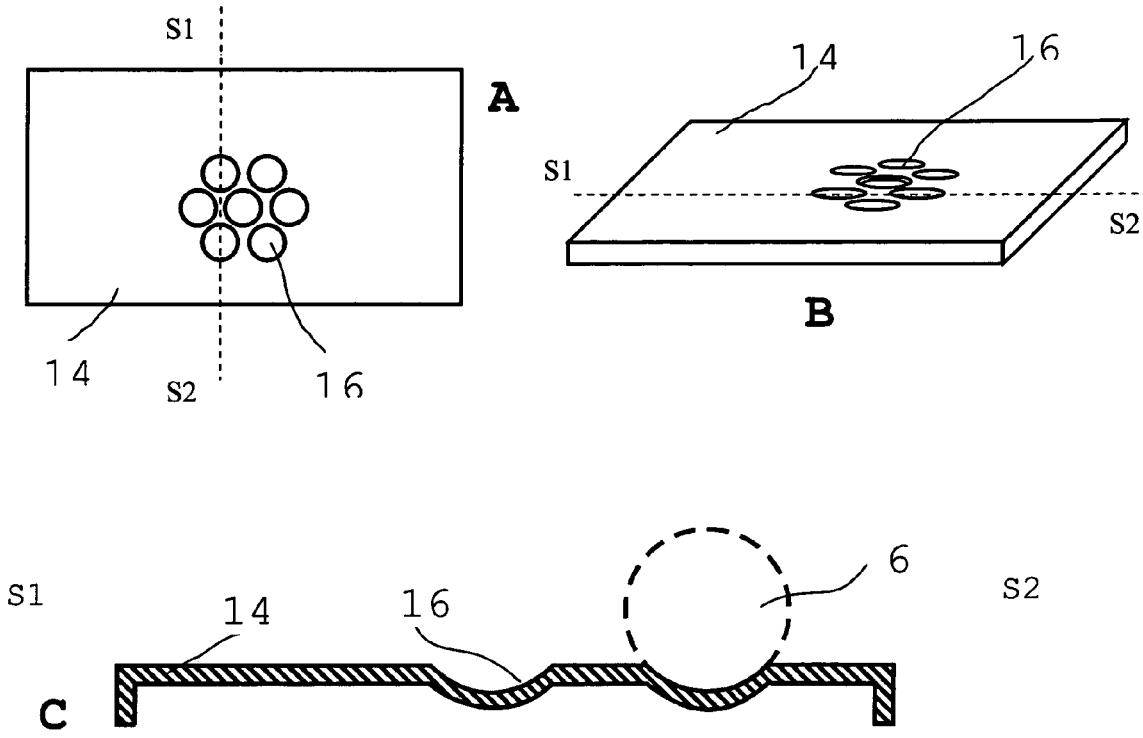
FIG. 11 illustrates a stair plate with a plurality dimples from a set of building blocks needed to assemble the toy stairway: A—top view, B—isometric view, C—cross-section of a stair plate and a ball in the dimple along the line S1–S2.

The regular set of parts assembled to play the proposed in present invention game is illustrated in FIG. 1 and FIG. 11. The set includes of 6-level stairway 2, the spring toy 4 with trapping mechanism. The spring toy 4 is initially placed at a starting position on a top stair and articles in the form of balls 6 placed on five lower stairs. The stairway 2 generally includes one or more full posts 10, half posts 12, stair plates 14 and base plates 18.

The stairway 2 may be assembled using modified universal toy building blocks with connectors. Examples of such blocks are disclosed, e.g., in U.S. Pat. No. 3,005,282 issued on Oct. 24, 1961, which is incorporated herein by reference. Such blocks are sold under the trademarks DUPLO™, MEGABLOKS™, and others. Such blocks are well known and are convenient for children of different ages. In addition, the blocks can be used to build any other constructions. Using such blocks it is also possible to construct as many stairs as a child wants at his/her age or skill level. A size of a package of the proposed product, containing the number of blocks needed to build a 6-step stairway and all other parts of the game, is compact enough and is comparable with product packages marketed presently by vendors mentioned above. Kits using a greater or lesser number of stairs are within the scope of embodiments of the present invention.

The universal building blocks may be modified in size and features. For example, FIGS. 2–5 illustrate a set of four basic block types to be used for stairway construction. Blocks' dimensions are given in Length×Width×Height, using DUPLO® or MEGABLOKS™ in terms of the number of male connectors 8 (or corresponding female connectors on the reverse side of any block) for length and width and the smallest brick as a unit for the height (for example, one brick may be about ¾" high).

FIG. 2 shows a full width post 10 with a size of 2×2×4 from different views. FIG. 3 represents a half width post 12 with a size 2×1×4 from different views. Both posts are of the same length and height. The height of the posts may be approximately the height of spring toy 4 when it is in a collapsed state, e.g. as shown in FIG. 1.

Figure 4:
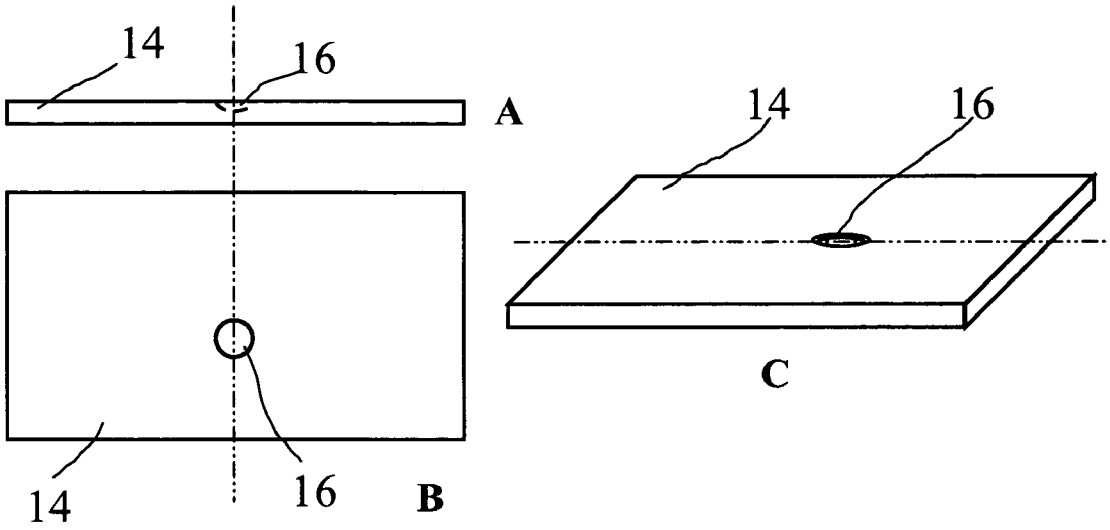
FIG. 4. Illustrates a stair plate from a set of building blocks needed to assemble the toy stairway: A—side view, B—top view, C—isometric view.

FIG. 4 illustrates from different views a stair plate 14 having a size of 10×8×½ and is half a brick thick. Female connectors on the back surface of the stair plate 14 may be counted to define its horizontal dimensions. An upper surface of the stair plate 14 may be substantially flat and may have no male connectors. The upper surface may include a dimple 16 for placing the ball. The dimple 16 may be located one connector aside from the plate center along the plate's width towards the lower stairs, i.e. its position on the plate is located between the $5^{th}$ and $6^{th}$ connector along the plate's length and between the $5^{th}$ and $6^{th}$ connector along the plate's width in direction from top to base. Note that the stairs may have more than one dimple 16, as shown in FIG. 11.

Figure 5:
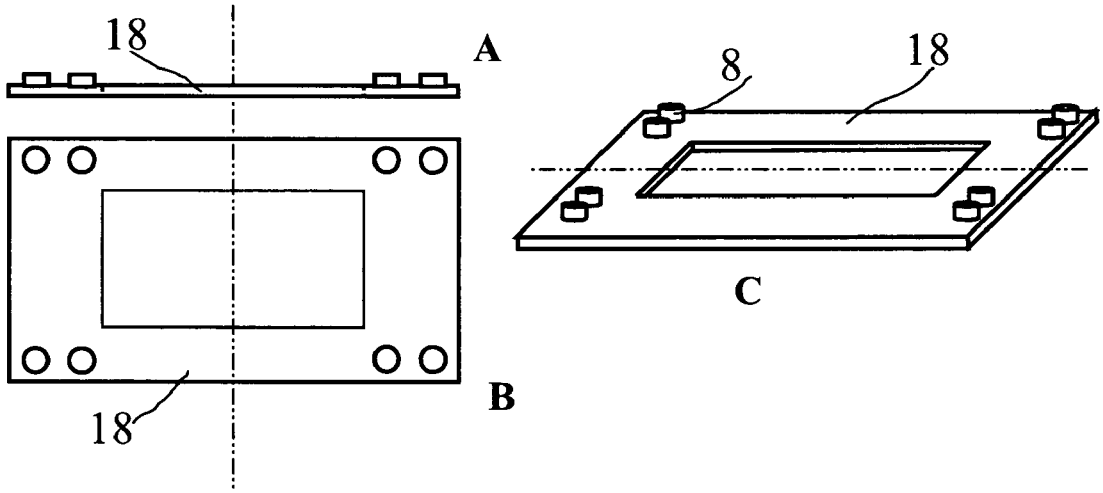
FIG. 5. Illustrates a base plate from a set of building blocks needed to assemble the toy stairway: A—side view, B—top view, C—isometric view.

The base plate 18, which may be made of flexible plastic, is a quarter brick thick with dimensions 10×8×¼ and is shown from different views in FIG. 5. The horizontal dimensions of the base plate 18 are the same as for the stair plate 14. There may be two or more male connectors at each of four corners of the base plate 18. There may be no connectors on the back surface of the base plate 18. The purpose of the base plate 18 is to fix the positions of posts, making the whole construction more stable especially on slippery surface such as hardwood/laminate floor or on soft surface like carpet. The number of such base plates is equal to the number of stair plates, as shown on FIG. 1.

Figure 6:
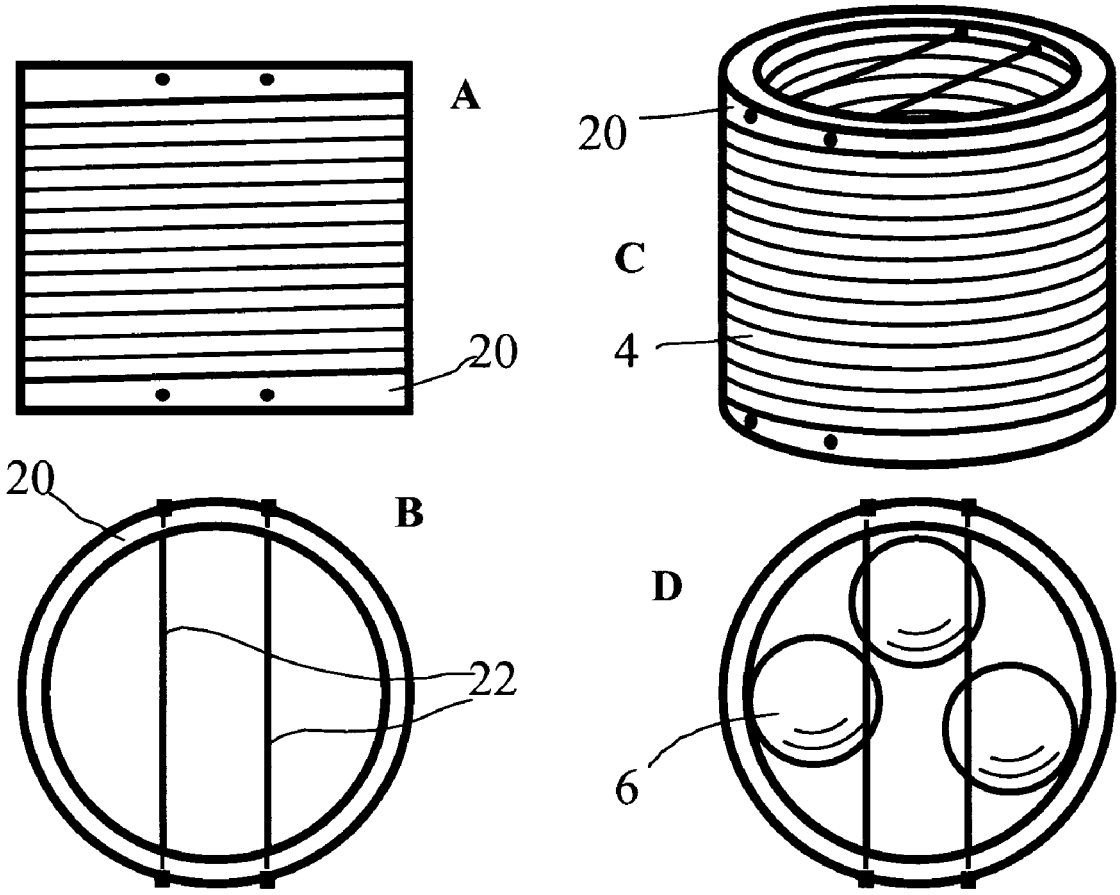
FIG. 6. Illustrates a spring toy with the ball-trapping tool and captured balls: A—side view, B—top view, C—isometric view, D—top view of captured balls inside spring toy space.

The coil spring toy may be based on a type of resilient coil having a fairly large number of coils and a relatively low spring constant (ratio of applied force to spring extension). Examples of such spring toys are sold under the trademark SLINKY®. The resilient coil may be made of metal or plastic. By way of example, the dimensions of a collapsed coil spring toy may be between about 2½" and 3" in height and about 3" in diameter. One or both ends of the spring toy 4 may be suitably modified to trap the balls 6. For example, as shown in FIG. 6, the spring toy 4 may include at one or both ends a solid ring 20, which can be formed by means of union of the last few coils at manufacturing stage or made separately and attached to the last coil of spring toy. Note that although FIG. 6 depicts spring toy 6 in the shape of a substantially cylindrical coil, other coil shapes, e.g., square, rectangular, etc., may be used.

Figure 9:
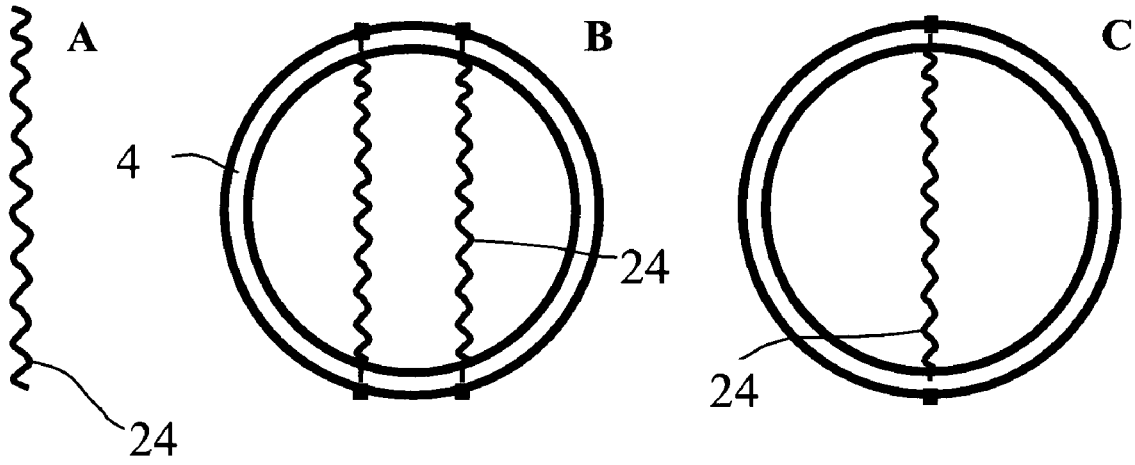
FIG. 9. Illustrates alternative thin spring thread design (A) for the ball-trapping tools (B and C).

As shown on FIG. 6 and on FIG. 9B two thin elastic flexible threads 22, 24 may be mounted at each ring so that they divide the ring internal area into three sub-areas. Each sub-area width measured along the ring diameter perpendicular to the threads may be about ⅓ of ring internal diameter. The central sub-area may be slightly narrower, e.g., a few millimeters narrower, than the side sub areas. This difference is necessary, because central sub-area is formed by two elastic threads and is more flexible for ball capture, while side sub-areas are limited by one thread and ring edge, therefore having less flexibility. The threads may be made of thin fishing line or similar material or they can be made as a thin spring 24, as shown in FIG. 9. The threads may be mounted to each ring (FIG. 6 and FIG. 9) by means of: pulling out their both ends through small holes made on the side surfaces of the ring; melting those thread ends filling up those holes; finishing the holes with appropriate lightweight notches. There may be alternative ways of mounting the threads to the ring, e.g., to tie the knots at both ends of the threads or there may be one thread going through all four holes and its both ends are tied to each other with appropriate finishing or any other. The ball diameter may be a few millimeters greater than ⅓ of ring internal diameter, and greater than any sub-area maximal width.

Figure 10:
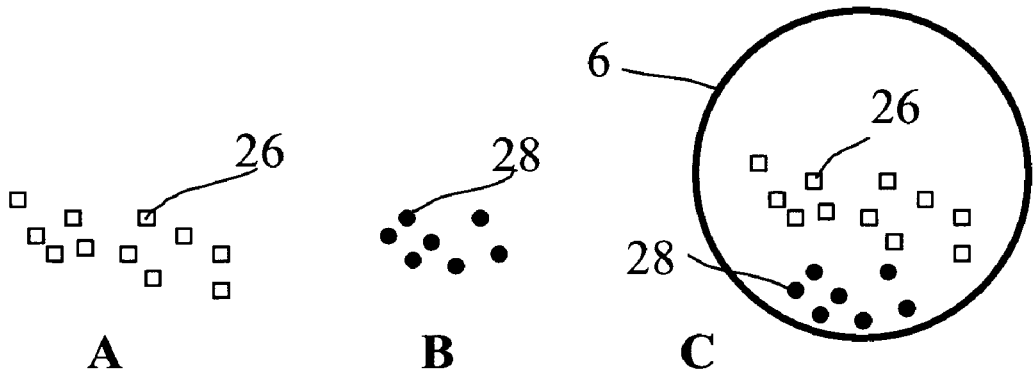
FIG. 10. Illustrates hollow transparent lightweight ball filled with lightweight particles for producing additional effects: A—particles for producing visual effects, B—particles for producing sound effects, C—a ball filled with particles.

The balls 6 may be lightweight balls based on known table tennis balls (or similar) but of specific size. The balls 6 may be hollow and made of thin plastic. The balls may look like regular table tennis balls but smaller in size. The balls 6 can be made of transparent plastic and can be filled with lightweight particles of two different types e.g., as shown in FIG. 10. The first type of particles 26 may be made of foil of different or specific colors to provide additional visual effect while the ball is in motion. The second type of particles 28 may be made of lightweight material (plastic or metal or similar material) producing different or specific sounds while the ball is moving. The ratios between ring sub-area width and ball size, and thread elasticity and ball weight may be adjusted to provide a reliable ball-trapping tool. Preferably, the balls can be pushed in through the threads by spring toy weight, but balls can't be pushed out by their own weight or by the total weight of all captured balls.

Figure 7:
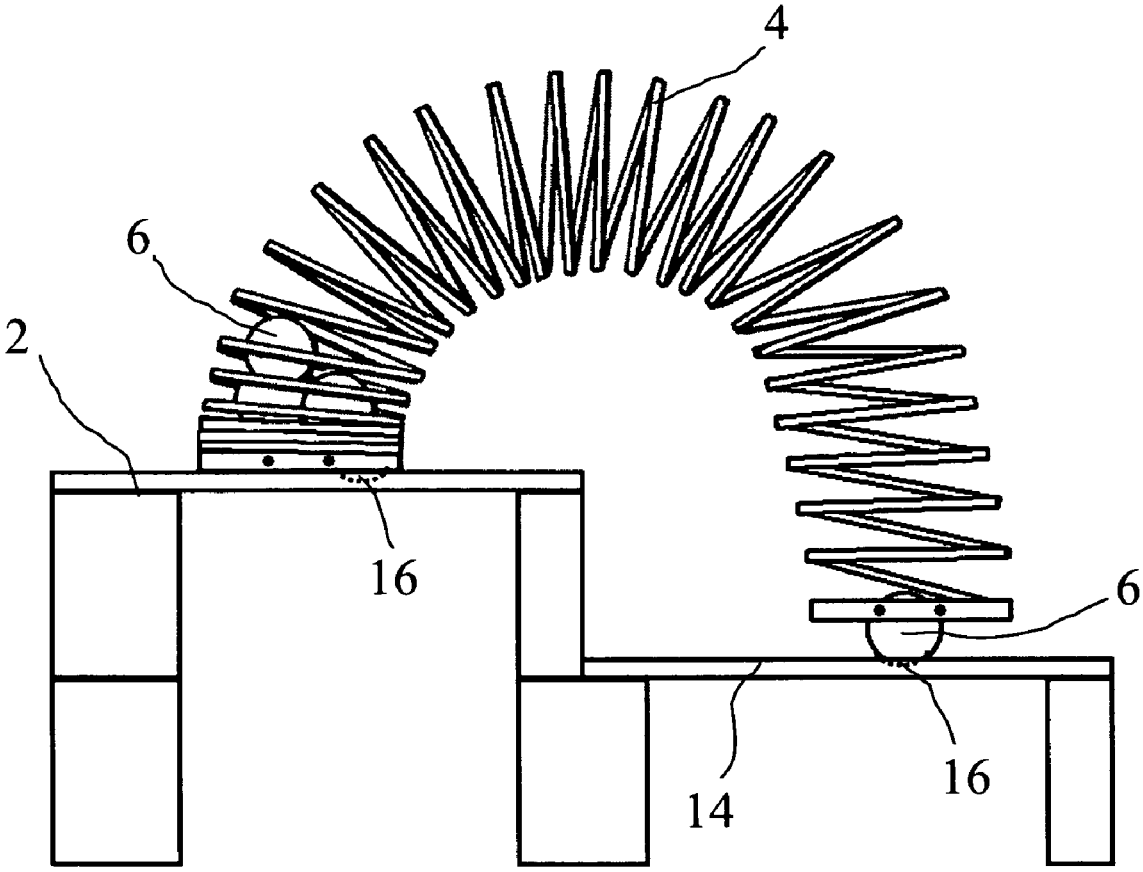
FIG. 7. Illustrates the side view of the last two stairs assembled from building blocks with a spring toy, capturing and retaining lightweight hollow plastic balls located on the stairs.

The spring toy 4 may be started from the collapsed position by advancing one of the top coils of the spring toy 4 to the next lower level so that the spring toy 4 moves down the staircase 2 in a well-known walking-type motion, e.g., as shown in FIG. 7. If spring toy is started properly, i.e. its landing ring center is positioned with appropriate accuracy relative to a ball located on the next lower stair, there is a high probability that ball will be trapped due to following geometrical and physical considerations. If the main portion of the ball projection area will be inside of any ring's sub-area (FIG. 6D), then the ball 6 will be (FIG. 7): (1) supported from beneath by the stair plate 14; (2) pushed down from above by the spring toy 4 and ball-trapping tool; (3) prevented from rolling in any direction along the stair plate 14 by dimple 16. The ball 6 can be pushed through the threads 22 or between one of the threads 22 and the inside edge of the ring 20 by the spring toy 4 due to its increasing weight while it is landing on the stair as shown in FIG. 7.

Figure 8:
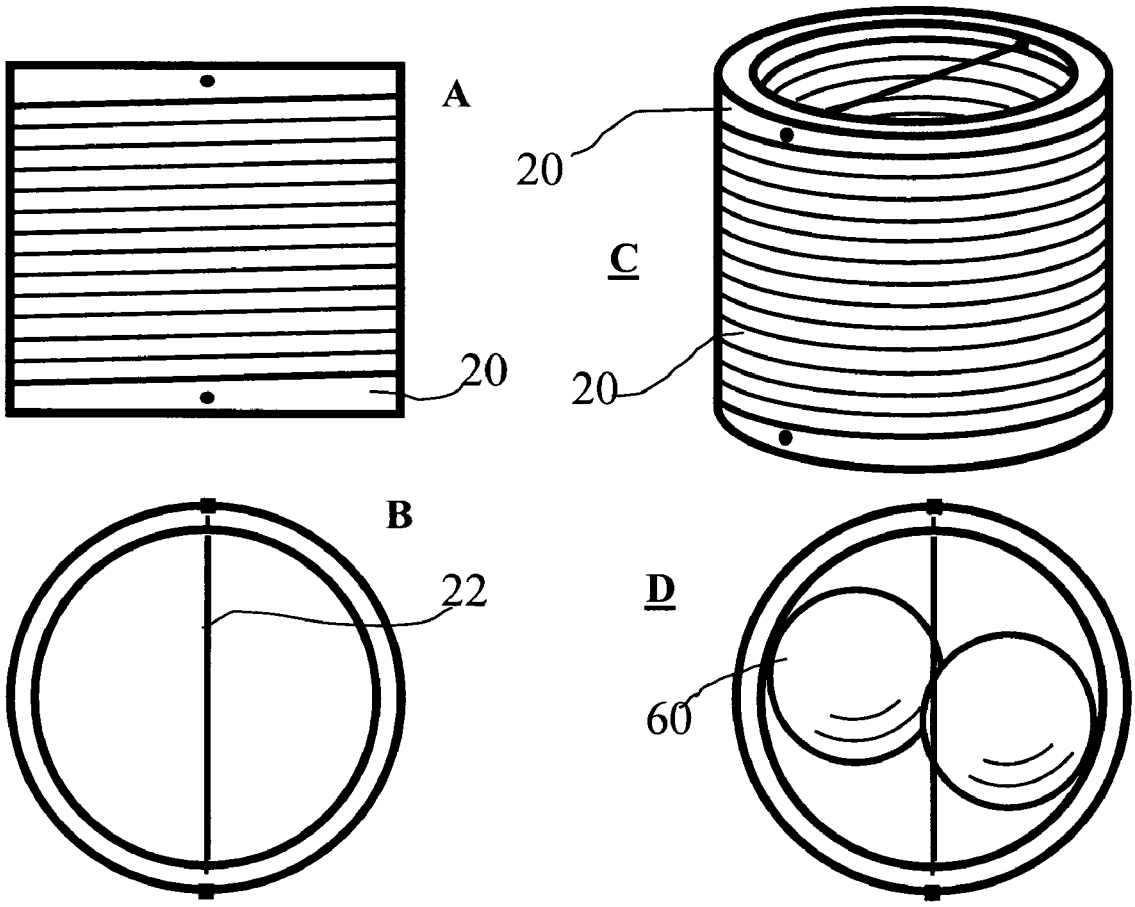
FIG. 8. Illustrates another version of spring toy design with the ball-trapping tool based on one thread and captured balls: A—side view, B—top view, C—isometric view, D—top view of captured balls inside spring toy space.

Experiments have been conducted showing that captured balls 6 will not come out of the inside space of the spring toy 4 between its stretched coils while it moves downstairs because the ball diameter is greater than distance between stretched coils at any moment. Therefore captured balls will be held inside spring toy space until it stops. Experiments have shown that up to 12 balls may be kept inside spring toy cylindrical space, allowing several actions to be played without releasing collected balls, using an extra ball set. The experiments were performed using several spring toys of the same diameter of about 3" but of different height in a range of 2⅝" to 2¾". The spring toys were made of plastic, having total number of turns in a range of 40 to 45. Elastic threads for ball-trapping tool were made of fishing line. The balls' diameter was slightly greater than ⅓ of spring toy internal diameter. The stairs were built from modified plastic blocks with dimensions of about 1.6 of spring toy diameter in width, about 2 spring toy diameters in length and about spring toy height in a collapsed state in height. A different ball-trapping tool can be also designed using one thin elastic thread 22 (as shown in FIG. 8) or thin spring 24 (as shown in FIG. 9C), dividing the ring area into two equal sub-areas. The ball diameter for this version of design is few millimeters greater than half of ring internal diameter. An example of this type of spring toy can capture and keep inside itself about three balls. Such version of the game with reduced number of stairs may be easier to play for younger children.

In an alternative embodiment of the invention, the number of the balls per stair might be more than one with appropriate number of dimples.

The game might be played at several levels depending on child age and skills: entry level, using few stairs without balls; intermediate level, using regular set of six stairs without balls or few stairs with the balls; high level, using regular set of stairs with balls; top level, using extended stairway and extra ball sets for multiple game actions. A different point values can be designated for each captured ball depending on ball position on a stairway and/or level of the game. The goal of the game is to gain the maximal number of points.

Figure 12:
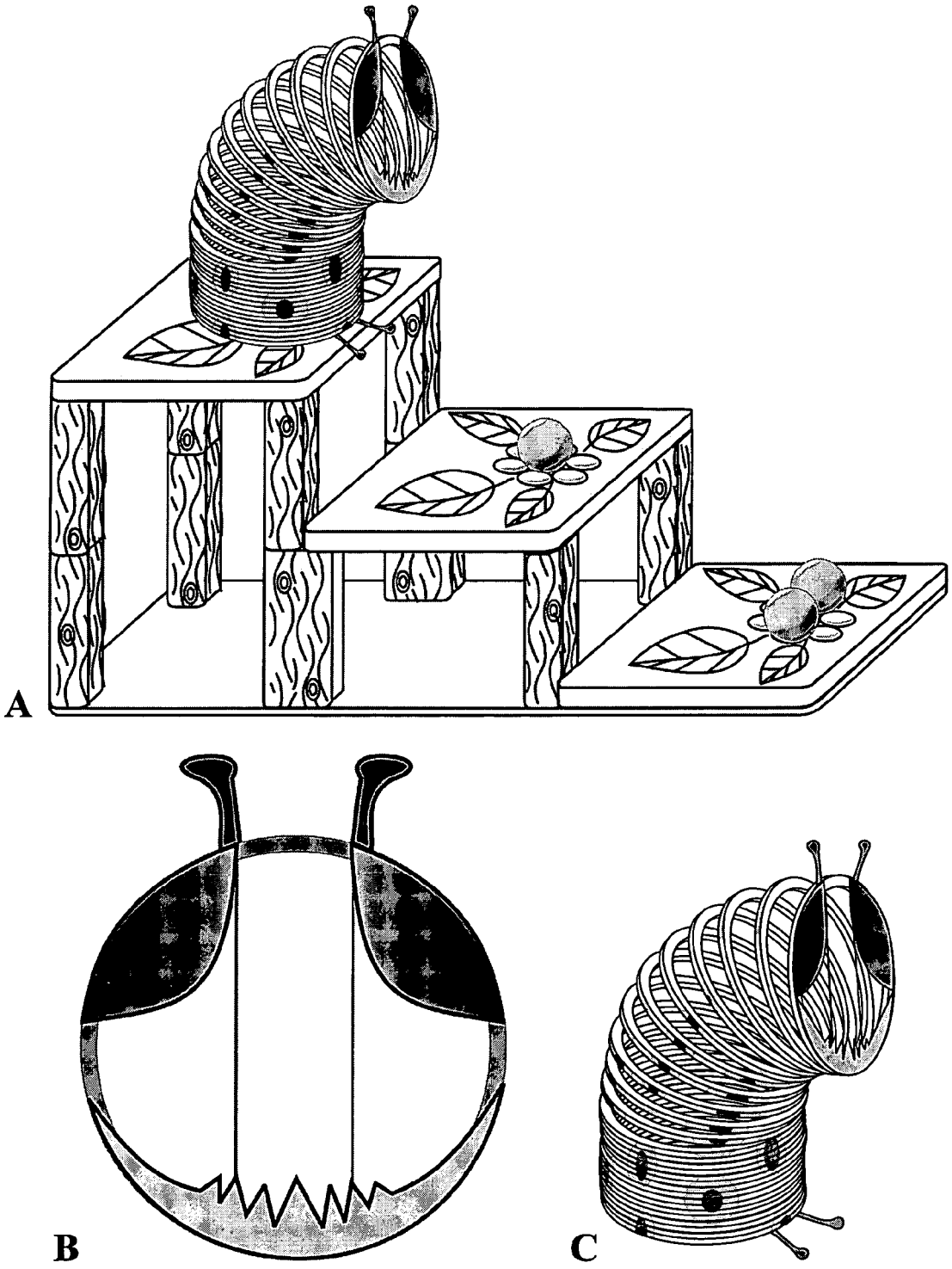
FIG. 12 illustrates an example of a spring toy apparatus designed to resemble an identifiable creature, object or environment. A—toy stairway designed to resemble a branch with balls on it designed to resemble fruits with a spring resembling caterpillar moving along the branch and "swallowing" fruits. B—top view of caterpillar head made of thin layer of lightweight material with mounted trapping tool, C—spring toy designed to resemble a caterpillar body with mounted caterpillar head and trapping tool.
Figure 13:
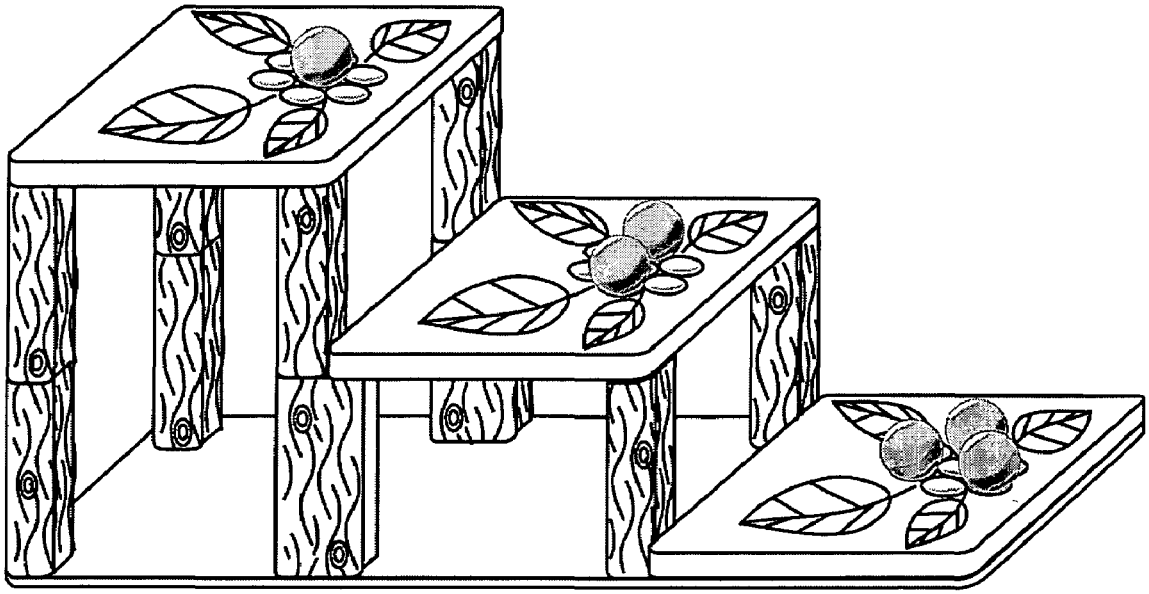
FIG. 13 illustrates an example of a toy stairway designed to resemble an identifiable environment, where a toy stairway is designed as a branch with balls on it designed as fruits.

The proposed apparatus and the game, i.e. a spring toy moving downstairs and capturing the balls, can be designed to resemble an identifiable creature, object or character catching different identifiable targets, e.g. a caterpillar moving along a branch and "swallowing" fruits and/or vegetables as shown in FIG. 12, or a diver collecting pearls on the sea floor or any other. Such a design may be achieved or enhanced by transforming the ring of the trapping tool into a head or other part of identifiable creature/object mentioned above. As an alternative solution said head or other part may be made of very lightweight material and mounted between the spring toy end and ball-trapping tool. An appropriate design of the stairway and balls may be done by transforming the posts, stair plates, base plates and balls into respective shapes and colors to form an identifiable environment, e.g. as shown in FIG. 13.

Embodiments of the present invention make toy spring games more interesting and more exciting for children of different ages and abilities, improving their building and coordination skills and competitive spirit.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A toy spring in the form of a resilient coil having a first end and a second end; and at least one trapping mechanism attached to one or more of the first and second ends, wherein the trapping mechanism is configured to trap articles within the resilient coil, wherein the trapping mechanism includes a ring having a diameter approximately equal to a diameter of the resilient coil and one or more flexible members attached to the ring and disposed across an area of the ring.

2. The toy of claim 1 wherein the one or more flexible members divide the area of the ring into two or more parts, wherein each part has a width that is less than a characteristic dimension of an article to be trapped.

3. The toy of claim 1 wherein the one or more flexible members include one flexible member that divides the ring area into two sub-areas of approximately equal width.

4. The toy of claim 1 wherein the one or more flexible members include two substantially parallel flexible members that divide the ring area into three sub-areas of approximately equal width, measured along the ring diameter in a direction substantially perpendicular to the parallel flexible members.

5. The toy of claim 1 wherein the flexible members are sufficiently flexible that the articles can be pushed between the flexible members or between one flexible member and a side of the ring by a force no greater than a weight of the toy spring, but the articles can't be pushed out by a force approximately equal to the total weight of all articles trapped within the resilient coil.

6. The toy of claim 1 wherein the ring is formed from one or more turns of the resilient coil, the one or more turns being proximate the first or second end.

7. The toy of claim 1 wherein the ring has the same diameter as the resilient coil and a thickness equal to two or more turns of the resilient coil.

8. The toy of claim 1 wherein the articles include one or more balls.

9. The toy of claim 1 wherein the at least one trapping mechanism includes a first trapping mechanism attached to the first end and a second trapping mechanism attached to the second end, wherein the first and second trapping mechanisms are configured to trap articles within the resilient coil.

10. The toy of claim 1 wherein the toy spring is designed to resemble an identifiable creature, or character.

11. The toy of claim 10, wherein the toy spring includes a head or other part of the identifiable creature, or character, wherein the head or other part is attached to the resilient coil proximate the trapping means.

12. The toy of claim 1, further comprising one or more articles configured to be trapped by the trapping means.

13. A toy kit, comprising:

a toy spring in the form of a resilient coil having a first and a second end, a first trapping mechanism attached to the first end for capturing articles and retaining the articles within the resilient coil and a second trapping mechanism attached to the second end, wherein the first and second trapping mechanisms are configured to trap articles within the resilient coil, wherein the first and/or second trapping mechanism includes a ring having a diameter approximately equal to a diameter of the resilient coil and one or more flexible members attached to the ring and disposed across an area of the ring; and a toy stairway having a plurality of steps.

14. The toy kit of claim 13 wherein each step includes one or more dimples for receiving one or more balls.

15. The toy kit of claim 13 wherein the toy stairway includes a set of universal toy building block connectors.

16. The toy kit of claim 15 wherein the set of universal toy building blocks includes:

a full width post in the form of a two by two connector block, having a height of about the resilient spring when it is in a collapsed state;

a half width post in the form of a two by one connector block, having the same height as said full width post;

a stair plate, having horizontal dimensions of ten by eight connectors, with a flat upper surface with one or more dimples on said surface, each dimple for receiving one of the balls; and a base plate, having the same horizontal dimensions as said stair plate, with two pin connectors at each of its four corners.

17. The toy kit of claim 13 further comprising a plurality of balls.

18. The toy kit of claim 17 wherein the balls are hollow and made of thin plastic, having specific diameter of about one third and/or about half of spring toy diameter.

19. The toy kit of claim 17 wherein the balls are transparent and filled with lightweight particles that produce visual and/or sound effects when the balls are in motion.

20. The toy kit of claim 19 wherein the particles are of different colors.

21. The toy kit of claim 13 wherein the toy spring is designed to resemble an identifiable creature, of or character.

22. The toy kit of claim 21, further comprising a head or other part of the identifiable creature, or character, wherein the head or other part is attached to the resilient coil proximate the first or second trapping mechanism.

23. The toy kit of claim 21 wherein the toy stairway is designed to resemble an identifiable environment.

24. The toy kit of claim 21 further comprising one or more articles designed to resemble identifiable targets that the creature, or character captures.

25. A method for playing a game with a toy spring in the form of a resilient coil having a first and a second end, and one or more trapping mechanisms attached to one or more of the first and a second trapping mechanism attached to the second end, wherein the first and second trapping mechanisms are configured to trap articles within the resilient coil, the method comprising the steps of:

placing the resilient coil on a top step of a toy stairway having a plurality of steps;

placing an article on one or more of the steps; and initiating a motion of the resilient coil down the steps in a walking-type motion;

whereby the one or more trapping mechanisms trap articles that are sufficiently centered with respect to the trapping mechanism as the resilient coil lands on each step.

* * * * *